US007152519B2

(12) United States Patent
Dubreuil

(10) Patent No.: US 7,152,519 B2
(45) Date of Patent: Dec. 26, 2006

(54) HYDRAULIC ROTATOR AND VALVE ASSEMBLY

(75) Inventor: Mario Dubreuil, Lac Etchemin (CA)

(73) Assignee: Rotobec Inc., Quebec (CA)

( * ) Notice: Subject to any disclaimer, the term of this patent is extended or adjusted under 35 U.S.C. 154(b) by 0 days.

(21) Appl. No.: 11/129,676

(22) Filed: May 13, 2005

(65) Prior Publication Data

US 2006/0117946 A1 Jun. 8, 2006

Related U.S. Application Data

(60) Provisional application No. 60/632,977, filed on Dec. 6, 2004.

(51) Int. Cl.
*F01B 31/00* (2006.01)

(52) U.S. Cl. ..... 92/106

(58) Field of Classification Search ..... 92/106, 92/116

See application file for complete search history.

(56) References Cited

U.S. PATENT DOCUMENTS

| | | | |
|---|---|---|---|
| 3,760,840 | A | 9/1973 | Gates |
| 3,908,695 | A | 9/1975 | Dunbar |
| 3,966,249 | A | 6/1976 | Lindqvist |
| 4,211,252 | A | 7/1980 | Pezzini et al. |
| 4,274,797 | A | 6/1981 | Coon |
| 4,333,676 | A | 6/1982 | Thumm |
| 4,597,410 | A | 7/1986 | Wilke |
| 4,836,240 | A | 6/1989 | Elliott |
| 4,947,646 | A | 8/1990 | Lenz |
| 4,989,652 | A | 2/1991 | Hansson |
| 5,078,560 | A | 1/1992 | Patrick et al. |
| 5,127,313 | A | 7/1992 | Yonezawa |
| 5,129,438 | A | 7/1992 | Hamilton |
| 5,188,146 | A | 2/1993 | Cook, Jr. et al. |
| 5,228,735 | A | 7/1993 | Morrow, Sr. |
| 5,238,357 | A | 8/1993 | Patrick et al. |
| 5,256,023 | A | 10/1993 | Patrick et al. |
| 5,377,913 | A | 1/1995 | Van Der Woude |
| 5,536,133 | A | 7/1996 | Velez et al. |
| 5,806,565 | A | 9/1998 | Kadlicko |
| 5,908,060 | A | 6/1999 | Fargeot |
| 6,216,729 | B1 | 4/2001 | Hambly et al. |
| 6,266,901 | B1 | 7/2001 | Kanda et al. |
| 6,280,119 | B1 | 8/2001 | Ryan et al. |
| 6,581,639 | B1 | 6/2003 | Fiala et al. |
| 6,585,079 | B1 | 7/2003 | Weyer |
| 6,782,910 | B1 | 8/2004 | Mondani et al. |
| 6,848,473 | B1 | 2/2005 | Fiala et al. |
| 2002/0050295 | A1 | 5/2002 | Fiala et al. |
| 2003/0115864 | A1 | 6/2003 | Mickelson |
| 2003/0164189 | A1 | 9/2003 | Mondani et al. |
| 2003/0201016 | A1 | 10/2003 | Fiala et al. |
| 2004/0103945 | A1 | 6/2004 | Fiala et al. |
| 2005/0017528 | A1 | 1/2005 | Ekman |

*Primary Examiner*—Edward K. Look
*Assistant Examiner*—Michael Leslie
(74) *Attorney, Agent, or Firm*—Knobbe, Martens, Olson & Bear, LLP.

(57) ABSTRACT

A motor-driven hydraulic rotator assembly for use on articulated-boom excavating equipment, or the like, for rotating and actuating an operable attachment. The rotator assembly comprises concentric tubular oil distribution channels located within the load-bearing shaft and drive assembly. In a preferred embodiment, the motor comprises a hydraulic pressure relief valve to decrease a low pressure side of the motor.

16 Claims, 5 Drawing Sheets

HYDRAULIC ROTATOR AND VALVE ASSEMBLY

RELATED APPLICATION

This application is a non-provisional application claiming priority under 35 U.S.C. § 119(e) of Provisional Application No. 60/632,977 filed Dec. 6, 2004.

FIELD OF THE INVENTION

The present invention generally relates to hydraulic rotators for use on articulated-boom excavating equipment, or the like. More particularly, it relates to a motor-driven rotator assembly having concentric tubular oil distribution channels and further preferably comprising a hydraulic pressure relief valve to decrease a low pressure side of the motor.

BACKGROUND OF THE INVENTION

Mobile excavating machines are commonplace in commercial industries. These machines often have hydraulically-driven rotator assemblies for rotation of manipulating or grappling equipment secured to the end of the articulated booms. These rotator assemblies have oil pressure lines that must be displaced with the rotator assembly, as the grappling equipment is swivelled. These rotator assemblies also are capable of continuous rotation about their main shaft. However, a disadvantage of some of these rotator assemblies is that they have heavy mechanical parts.

With most prior art rotator assemblies, because the grappling equipment is connected directly to the rotator assembly, the rotor assembly parts are subjected to torque and different axial or radial loads. These loads induce stress on the collector and lead to wearing of bearings, seals and couplings. The collector eventually also can develop hydraulic fluid leaks, thereby necessitating repairs. In certain cases, replacement of the entire rotator assembly and grappling equipment is required, which increases maintenance costs.

US 2004/0168568 describes an example of a rotator found in prior art. In such a rotator design, the lower end of the load-bearing shaft is provided with annular oil distribution channels which are in communication with oil pressure line connectors, which extend through the collector jacket. These oil distribution channels communicate with supply channels which are bored into the load-bearing shaft, and oil is fed to the supply channels through oil line connectors, which connect to the oil pressure lines. However, this design is still relatively bulky in size.

U.S. Pat. No. 6,266,901 discloses another example of a rotator found in the prior art. In this case, the oil supply channels are placed in proximity of each other in symmetrical configurations within the rotator structure. Unfortunately, this design also results in a relatively bulky design which causes stresses to the rotator structure due to the rotative movement of the internal components such as the oil supply channels which have an offset with respect to the center axis of the rotator.

Thus, there is still presently a need for an improved rotator design that is small in size and incurs lower maintenance costs due to improved rotative movement of its internal components.

Additionally, there is a need for an improved hydraulic valve design. If an operator wishes to immobilise an object being held with the grappling equipment, the operator must control valves that feed the rotator hydraulic line. The rotator hydraulic line is thus theoretically isolated from the other hydraulic lines. In certain cases, the rotator axis might be immobilised in a horizontal configuration. In this configuration, the load might not be aligned with the rotator axis and consequently, the motor must act to maintain the load in place. However, internal leaks in the hydraulic system result in that a small quantity of oil is sent to the rotator hydraulic line. In this situation, the hydraulic pressure increases on both sides of the motor. This condition is problematic for the motor. It is much more efficient to maintain a load in place if the low pressure side of the motor is drained towards the hydraulic reservoir. A pressure relief valve is therefore required to decrease pressure on the low-pressure side of the motor.

Prior art relief valves include hot oil shuttle valves. In these types of valves, the flow paths are connected or isolated by means of a movable sliding member. However, these valves are susceptible to internal oil leaks which decrease the capacity of the motor to maintain a load in place.

Consequently, there is still presently a need for a new type of hydraulic valve, which can decrease this pressure surrounding the motor when the rotator is immobilising an object being manipulated.

SUMMARY OF THE INVENTION

An object of the present invention is to propose a hydraulic rotator that satisfies at least one above-mentioned need.

According to the present invention, that object is achieved with a rotator having concentrically positioned tubular oil distribution channels located within the load-bearing shaft and drive assembly.

More particularly, the present invention provides a rotator assembly for rotating and actuating an operable attachment. The rotator assembly comprises:

a load-bearing shaft adapted to be mounted to a boom member displacing said rotator assembly; said load-bearing shaft having:

a central recess at a bottom end thereof; and a first and a second channel extending through the shaft, each of said first and second channel having a bottom end emerging in the central recess, said first and second channel allowing passage of a pressurized fluid used for actuating the operable attachment;

a drive assembly rotatably mounted about the load-bearing shaft, the drive assembly having a bottom body portion securable to the operable attachment, said bottom body portion having a central recess in an upper portion thereof in registry with the central recess of the load-bearing shaft and a first and a second channel in fluid communication with said central recess of the drive assembly; each of said first and second channel having a port in a bottom or side wall of the body portion for connection with hose means of the operable attachment;

an actuator operatively connected to the drive assembly such that an actuation force from the actuator is transmitted to the operable attachment to rotate the operable attachment about the load-bearing shaft;

a first tube having an upper end portion housed in the central recess of the load-bearing shaft and a lower end portion housed in the central recess of the drive assembly, said first tube having a top end in registry with the bottom end of said first channel of the load-bearing shaft and a bottom end in fluid communication with the first channel of the bottom body portion of the drive assembly, thereby allowing a first flow path for the pressurized fluid from the load-bearing shaft to the operable attachment; and a second tube concentrically positioned around the first tube and an annular passage between the first and second tube having an upper end in fluid communication with the bottom end of said second channel of the load-bearing shaft and a lower end in fluid communication with the second channel of the drive assembly, thereby allowing a second flow path for the pressurized fluid from the load-bearing shaft to the operable attachment.

In accordance with a preferred aspect of the invention, the rotator assembly comprises a collector housed in the central recess of the load-bearing shaft, the collector having a body with a central alcove in a bottom end thereof, said alcove housing the upper end portion of the first tube and having an upper opening in registry with the bottom end of said first channel of the load-bearing shaft and with the top end of the first tube, said body further having a passage with an upper end in registry with the bottom end of said second channel of the load-bearing shaft and a lower end emerging in said central alcove and being in fluid communication with the upper end of said annular passage to provide said second flow path.

The invention also provides a rotator assembly linking a boom member to an operable attachment, the rotator assembly comprising:

a stator mounted on one of the boom member and operable attachment, said stator having:

a central recess; and a first and a second channel extending through the stator, each of said first and second channels being in communication with said central recess;

a rotor rotatably mounted about the stator, the rotor having:

an interface securable to the other one of said operable attachment and boom member;

a central recess in registry with the central recess of the stator; and a first and a second channel in communication with said central recess of the rotor, each of said first and second channels having a port in a bottom or side wall of the rotor;

a first tube having a first end portion housed in the central recess of the stator and a second end portion housed in the central recess of the rotor, said first tube having said first end in communication with said first channel of the stator and said second end in communication with the first channel of the rotor, thereby allowing a first travel path from the boom member to the operable attachment; and a second tube concentrically positioned around the first tube and an annular passage between the first and second tube, said second tube having a first end in communication with the second channel of the stator and a second end in communication with the second channel of the rotor, thereby allowing a second travel path from the boom member to the operable attachment.

In accordance with another preferred aspect of the invention, the actuator fixed to the load-bearing shaft is a motor comprising a hydraulic valve, which can decrease the pressure surrounding the motor used as the actuator for the rotator. This valve reduces oil leaks between the high-pressure line of the motor and a reservoir. On the other hand, the low-pressure line of the motor communicates with the reservoir and the valve helps decrease pressure on the low-pressure side of the motor.

More particularly, in accordance with a preferred embodiment, the actuator is a motor which comprises a hydraulic valve to direct fluid flow from two hydraulic lines to a reservoir. The hydraulic valve comprises:

a body having a pair of supply ports and a reservoir port, the supply ports being in fluid communication with the hydraulic lines and the reservoir port being in fluid communication with the reservoir;

a first channel extending from the first supply port towards a center of the body and a second channel extending from the second supply port towards the center of the body, the two channels being coaxially aligned on opposite sides of the body, meeting at the center of the body and converging towards a transverse third channel extending towards the reservoir port;

first and second sealing surfaces having opposing outward tapers facing the first and second channels;

a shuttle including a central shaft and two balls affixed to the central shaft on opposite ends thereof, the shuttle being slidably movable between sealing engagement of the first ball with the first sealing surface and sealing engagement of the second ball with the second sealing surface;

first and second spring means in contact with the first and second balls respectively and adapted to apply a force on the balls towards the center of the body;

wherein a higher fluid pressure in the first supply port compared to the second supply port results in sealing engagement of the first ball with the first sealing surface while allowing fluid flow between the second supply port and the reservoir and a higher fluid pressure in the second supply port compared to the first supply port results in sealing engagement of the second ball with the second sealing surface while allowing fluid flow between the first supply port and the reservoir.

A non-restrictive description of a preferred embodiment of the invention will now be given with reference to the appended drawings.

DESCRIPTION OF PREFERRED EMBODIMENTS

Figure 1:
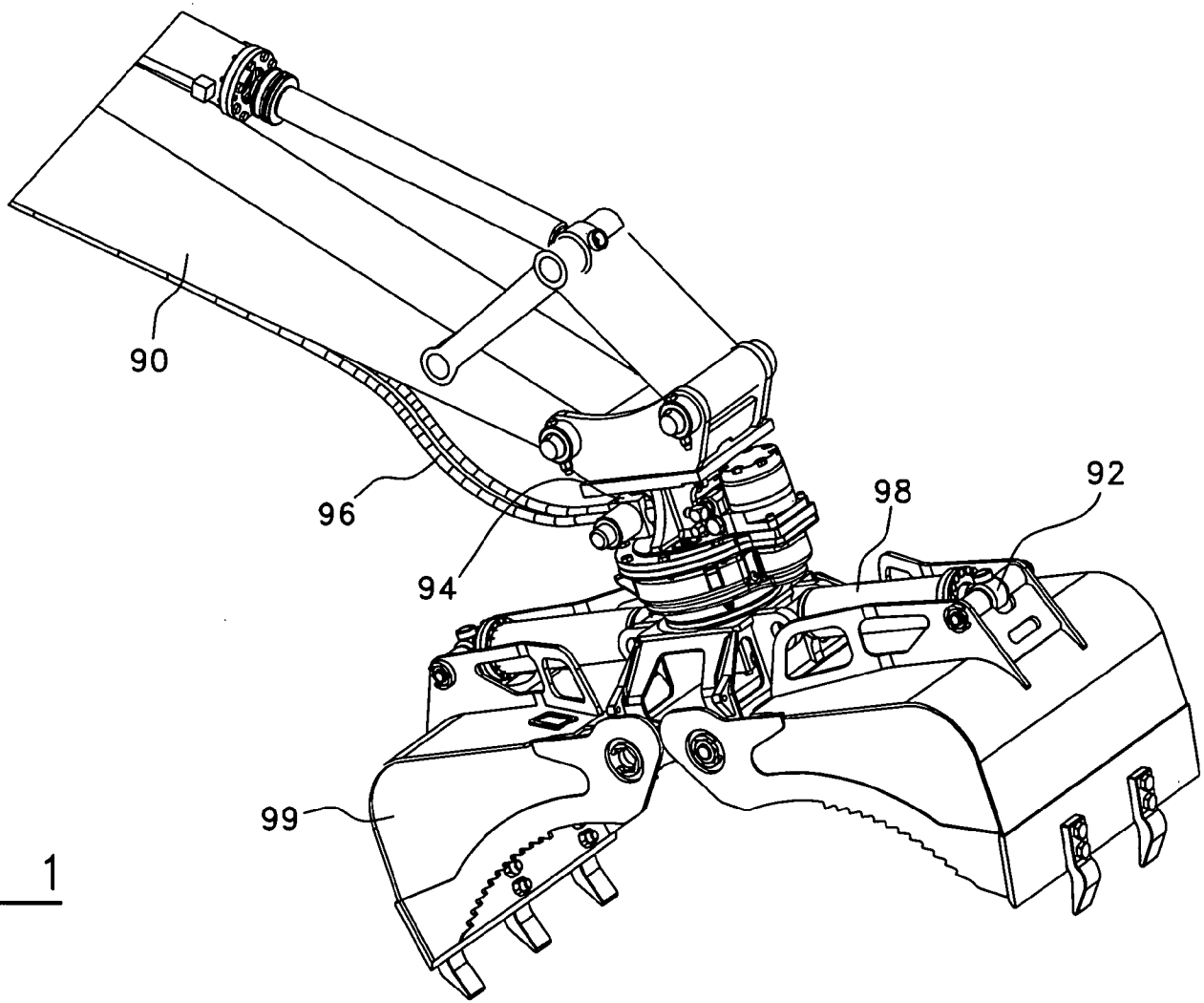
FIG. 1 is a perspective view of an excavator provided with a rotator assembly according to the present invention.

Referring to FIG. 1, there is shown generally an excavating vehicle equipped with an articulated boom 90 (or other suitable boom member), at the end of which is supported operable attachment 92, a grapple in this case. The operable attachment 92 is supported by a rotator assembly 94. Oil pressure lines 96 feed hydraulic fluid to the rotator assembly 94 which, in turn, connects this working fluid through additional pressure lines to cylinders 98 to actuate the grapple jaws 99.

In general, the rotator can be installed on the end of a machine having articulated booms. It is used to make the operable attachment 92 turn a continuous 360 degrees if necessary. The hydraulic oil pressure lines 96 that feed the actuating cylinders 98 must pass through the inside of a rotator assembly 94 to avoid becoming entangled around the rotator assembly 94.

Figure 2:
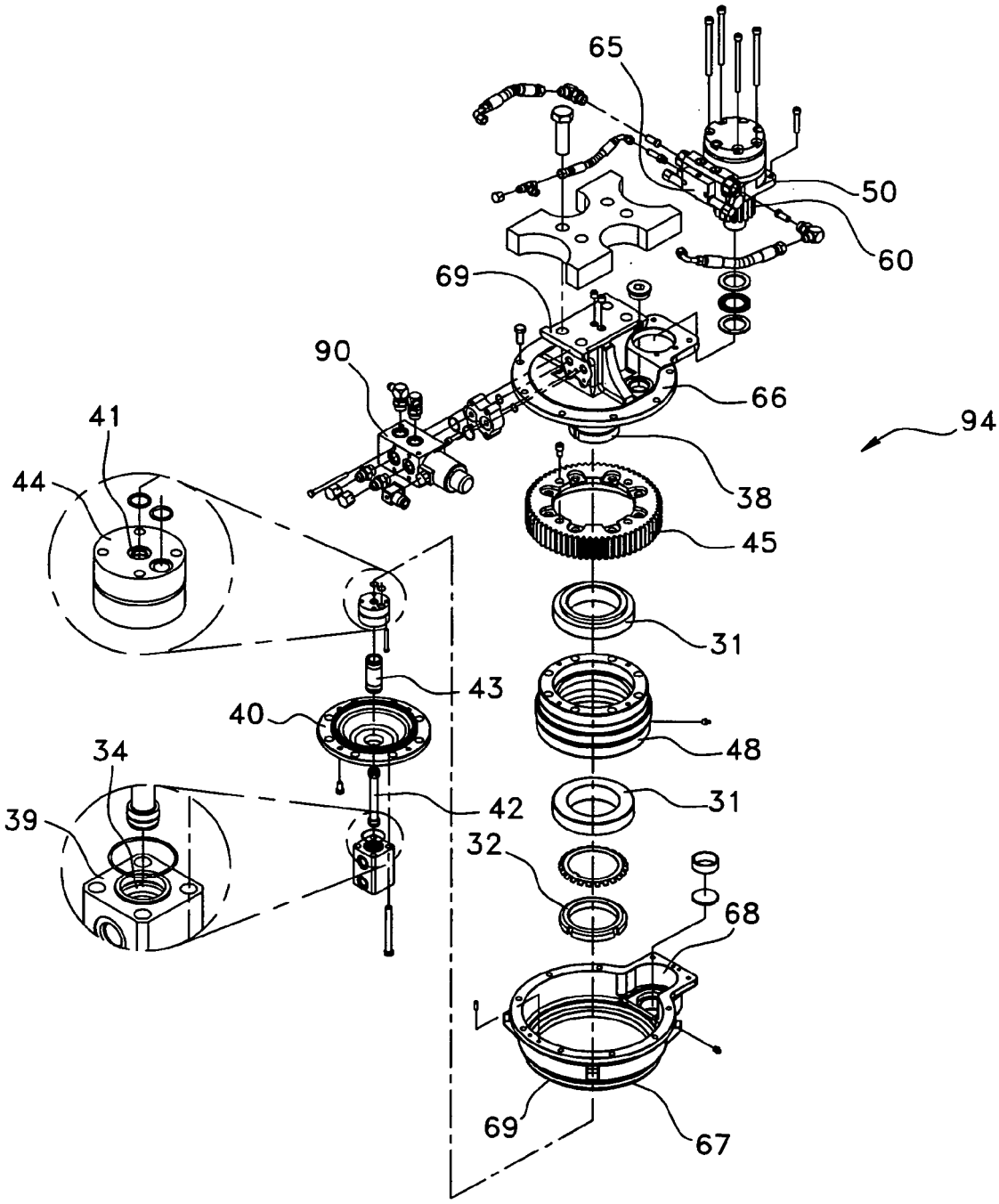
FIG. 2 is an exploded view of the rotator assembly according to a preferred embodiment of the present invention.
Figure 3:
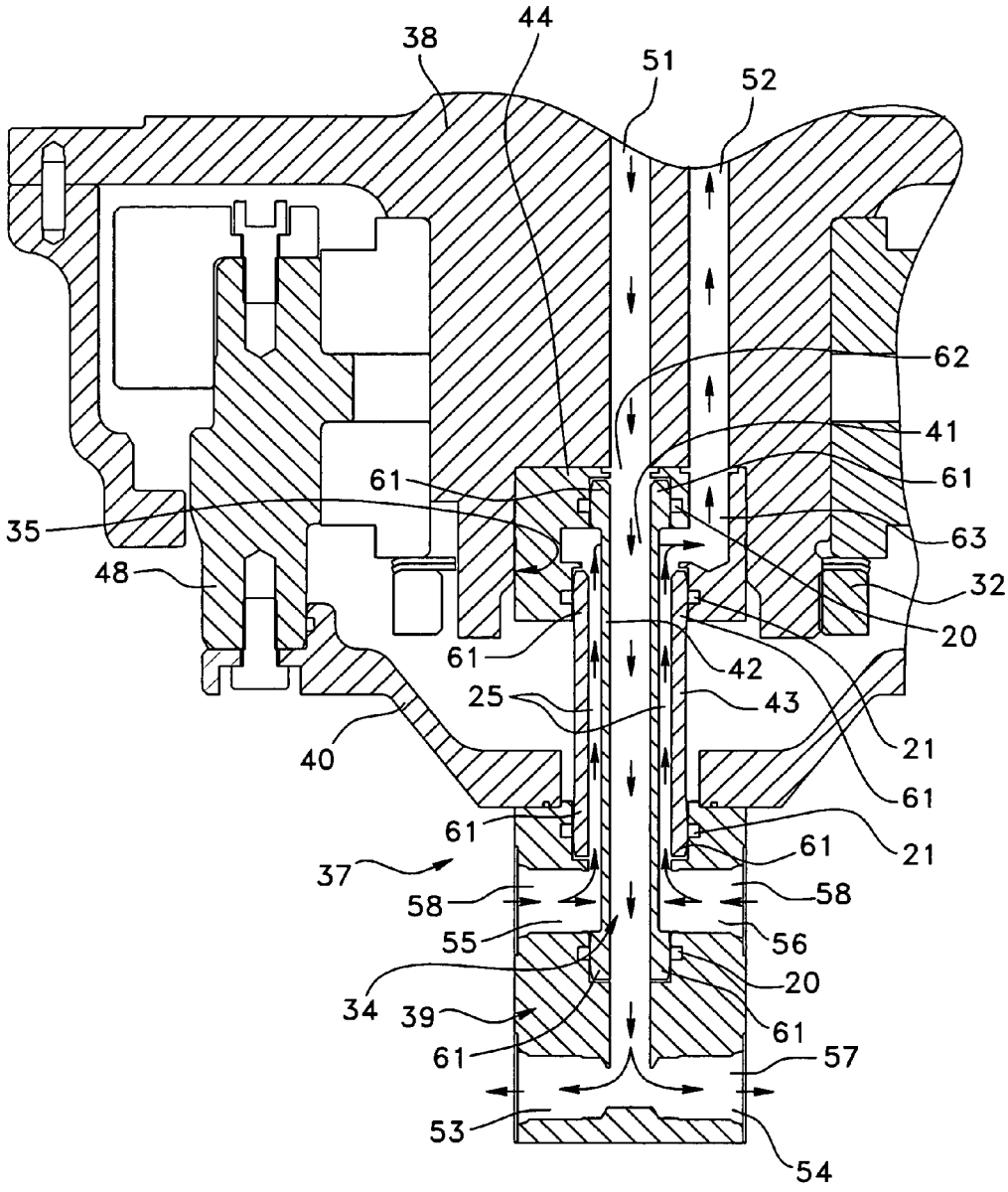
FIG. 3 is a section view of the rotator assembly according to a preferred embodiment of the present invention, illustrating the hydraulic fluid distribution channels.

Referring to FIGS. 2 and 3, the present invention provides a rotator assembly 94 for rotating and actuating the operable attachment 92. The rotator assembly 94 comprises a load-bearing shaft 38 adapted to be mounted to the boom member 90 displacing the rotator assembly 94. The load-bearing shaft 38 has a central recess 35 at a bottom end thereof, a first and a second channel 51,52 extending through the shaft 38, each of the first and second channel 51,52 having a bottom end emerging in the central recess 35. The first and second channels 51, 52 allow passage of a pressurized fluid used for actuating the operable attachment 92. Preferably, the load-bearing shaft 38 is part of an attachment structure 66 having a top side with a boom interface 69 to permit attachment of the rotor assembly to the boom member 90 of the excavating vehicle. The load-bearing shaft 38 extends from the bottom side of the attachment structure 66.

The assembly may also further comprise a selection valve 90 to control the fluid entering and exiting the assembly.

The rotator assembly 94 also comprises a drive assembly 37 rotatably mounted about the load-bearing shaft 38. The drive assembly 37 has a bottom body portion 39 securable to the operable attachment 92. As best viewed in FIG. 3, this bottom body portion 39 has a central recess 34 in an upper portion thereof in registry with the central recess 35 of the load-bearing shaft 38 and a first and a second channel 57, 58 in fluid communication with the central recess 34 of the bottom body portion 37. Each of the first and second channels 57, 58 has a port 53,54,55,56 in a bottom or side wall of the body portion for connection with hose means of the operable attachment 92.

The rotator assembly 94 also comprises an actuator 50 fixed to the load-bearing shaft 38 and being operatively connected to the drive assembly 37 such that an actuation force from the actuator 50 is transmitted to the operable attachment 92 to rotate the operable attachment 92 about the load-bearing shaft 38. Preferably, and as best shown in FIG. 2, the rotator comprises a motor 50 mounted to the attachment structure 66 and a pinion gear 60 operatively connected to the motor. On its side, the drive assembly 37 preferably comprises a jacket-shaped bearing 48 rigidly connected to a top end of the bottom body portion 39. The jacket-shaped bearing 48 houses and surrounds the load-bearing shaft 38. An annular gear 45, which is in operative engagement with the pinion gear 60 of the actuator, is secured to a top end of the jacket-shaped bearing 48. In order to mount the jacket-shaped bearing 48 and annular gear 45 around the load-bearing shaft 38, the rotator assembly further preferably comprises a rotator casing 67 having a top side securable to the attachment structure 66 and a lodging 68 for receiving the pinion gear 60. The bottom body portion 39 projects out from an aperture provided in a bottom side 69 of the rotator casing 67.

As best shown in FIG. 3, the jacket-shaped bearing 48 is rigidly connected to the bottom body portion 39 by means of a conical cover 40 having a flared top side securable to a bottom end of the jacket-shaped bearing 48 and a bottom side securable to the top end of the bottom body portion 39.

As shown in FIG. 2, conventional bearings 31 and nuts 32 are used between the parts of the drive assembly 37.

The rotator assembly also comprises a first tube 42 having an upper end portion housed in the central recess 35 of the load-bearing shaft 38 and a lower end portion housed in the central recess 34 of the drive assembly 37. As best shown in FIG. 3, the first tube 42 has a top end in registry with the bottom end of the first channel 51 of the load-bearing shaft 38 and a bottom end in fluid communication with the first channel 57 of the bottom body portion 39 of the drive assembly 37, thereby allowing a first flow path for the pressurized fluid from the load-bearing shaft 38 to the operable attachment 92. The rotator assembly also comprises a second tube 43 concentrically positioned around the first tube 42 and an annular passage 25 between the first 42 and second tube 43 having an upper end in fluid communication with the bottom end of the second channel 52 of the load-bearing shaft 38 and a lower end in fluid communication with the second channel 58 of the bottom body portion 39 of the drive assembly 37, thereby allowing a second flow path for the pressurized fluid from the load-bearing shaft 38 to the operable attachment 92.

Preferably, the rotator assembly further comprises a collector 44 housed in the central recess 35 of the load-bearing shaft 38. As best shown in FIG. 2, the collector 44 has a body with a central alcove 41 in a bottom end thereof, the alcove 41 housing the upper end portion of the first tube 42 and having an upper opening 62 in registry with the bottom end of said first channel 51 of the load-bearing shaft 38 and with the top end of the first tube 42. The collector body further has a passage 63 with an upper end in registry with the bottom end of said second channel 52 of the load-bearing shaft 38 and a lower end emerging in the central alcove 41. The collector passage 63 is in fluid communication with the upper end of the annular passage 25 to provide the second flow path.

The hydraulic fluid or oil that is used to feed the grapple cylinders is sent through the first channel 51, passes through the internal tube 42 and exits through ports 53, 54 to head towards the cylinders. The oil that returns from the cylinders penetrates through ports 55, 56, passes between the internal tube 42 and external tube 43 through the annular passage 25 and exits through the second channel 52. For the cylinders to act in an opposite direction, the oil displacement is done in the opposite direction. Consequently, at least two degrees of actuation are provided by each channel.

In another embodiment of the present invention, the collector 44 is fully integrated to the load-bearing shaft 38, and is not an independent component.

The load-bearing shaft 38 is normally in a vertical position but could also be inclined by activating a positioning piston located on the booms. The load-bearing shaft 38 does not rotate. The collector 44 is fixed such that it does not move on the load-bearing shaft 38.

The interior tube 42 and the exterior tube 43 are trapped between the collector 44 and the drive assembly 37 but are free to move. Consequently, the tubes are free to rotate or not. Preferably, on each tube, each extremity has a spherical part 61 in proximity thereof. Seals 20 and 21 press against this spherical part 61.

Figure 4:
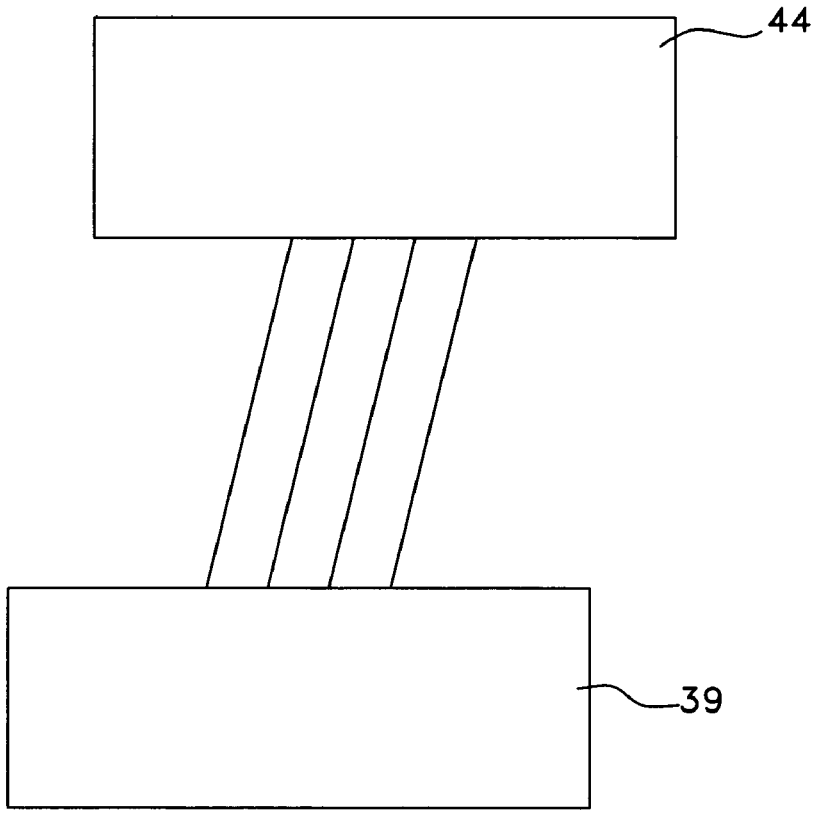
FIG. 4 is schematic side view illustration of an offset between the load-bearing shaft and the drive assembly.

As shown in FIG. 4, due to wear of the conical bearings, their incorrect positioning, the deflection of parts when subject to heavy loads and other reasons, the principal axis of the bottom body portion 39 does not always maintain a correct alignment with the collector 44 or the load-bearing shaft 38. In fact, the bottom body portion 39 could be eccentric or have an angular deflection with respect to the collector 44. However, stresses generated by this configuration can be alleviated. More specifically, the spherical portions 61 of the internal tubes 42 and external tubes 43 are pivotally connected to the inside of the bottom body portion 39 and of the collector 44. This freedom of movement results in an absence or a decrease of the stress being transmitted by the tubes 42 and 43. Since the seals 20, 21 are pressed against the spherical portions 61 of the tubes 42, 43, this movement does not cause any oil leaks.

Normally, the rotator assembly is positioned with a cylinder, but in another embodiment, the rotator assembly could be floating (i.e. positioned by the effect of gravity).

Consequently, the above-described rotator has the advantages of being small in size, low in cost and incurs lower maintenance due to improved rotative movement of the internal parts. Preferably, the rotator assembly has a modular design in which either the bottom body portion 39 of the drive assembly 37 or the collector 44 only have to be replaced during servicing, if required. This improves customer service as individual components of the rotator can be replaced without changing the complete rotator assembly.

This use of concentric tubes having spherical portions between the static and rotating parts of a rotator assembly can be used in several different rotator assembly designs. In another embodiment of the present invention, the rotator assembly may not have a motor driving the drive assembly which can then rotate freely. Moreover, in yet another embodiment, the rotator assembly comprises more than two concentric tubes, as several other concentric tubes linked to additional channels can be added around the first two tubes. In another embodiment of the present invention, the static and rotating parts of the rotator assembly are reversed in positioning such that the static part is mounted on the operable attachment and the rotating part is mounted on the boom member.

In another embodiment of the present invention, cabling or electronic wiring between the boom member and the operable attachment may be placed in the central first tube.

Consequently, the present invention also discloses a rotator assembly linking a boom member to an operable attachment. The rotator assembly comprises a stator mounted on one of the boom member and operable attachment. The stator has a central recess and a first and a second channel extending through the stator, each of the first and second channels being in communication with the central recess. The rotator also comprises a rotor rotatably mounted about the stator. The rotor has an interface securable to the other one of the operable attachment and boom member. The rotor also has a central recess in registry with the central recess of the stator and a first and a second channel in communication with the central recess of the rotor. Each of the first and second channels of the rotor has a port in a bottom or side wall of the rotor.

The rotator assembly also comprises a first tube having a first end portion housed in the central recess of the stator and a second end portion housed in the central recess of the rotor. The first end is in communication with said first channel of the stator and the second end is in communication with the first channel of the rotor, thereby allowing a first travel path from the boom member to the operable attachment. The rotator assembly also comprises a second tube concentrically positioned around the first tube and an annular passage between the first and second tube. The second tube has a first end in communication with the second channel of the stator and a second end in communication with the second channel of the rotor, thereby allowing a second travel path from the boom member to the operable attachment.

Preferably, the first and second travel path are flow paths for pressurized fluid.

In another preferred embodiment of the present invention, cabling is placed through the first travel path.

Preferably, the first and second tubes each comprise a first extremity and a second extremity, both extremities each having a spherical portion in proximity thereof, and the rotator assembly comprises a plurality of seals, each seal pressing against each of the spherical portions of the tubes.

Preferably, the spherical portions are pivotally connected to the stator and to the rotor.

Preferably, the rotator assembly further comprises an actuator operatively connected to the rotor such that an actuation force from the actuator is transmitted to the operable attachment to rotate the operable attachment about the stator.

Preferably, the stator comprises a load-bearing shaft and the rotor comprises a drive assembly.

In this system, a new type of hydraulic valve is also useful. If an operator wishes to immobilise an object being held with the grapple, the operator must control valves that feed the rotation hydraulic line. The rotation hydraulic line is thus theoretically isolated from the rest of the hydraulic lines. However, in certain cases, internal leaks in the hydraulic system result in that a small quantity of oil is sent to the rotation hydraulic line. In this case, the hydraulic pressure increases on both sides of the motor 50. This condition is problematic for the motor. Consequently, a hydraulic valve, which can decrease this pressure surrounding the motor 50 can eliminate this problem. As shown in FIG. 2, the hydraulic valve 65 is bolted on the rear of the hydraulic motor and becomes an integral part of the assembled motor 50.

Figure 5:
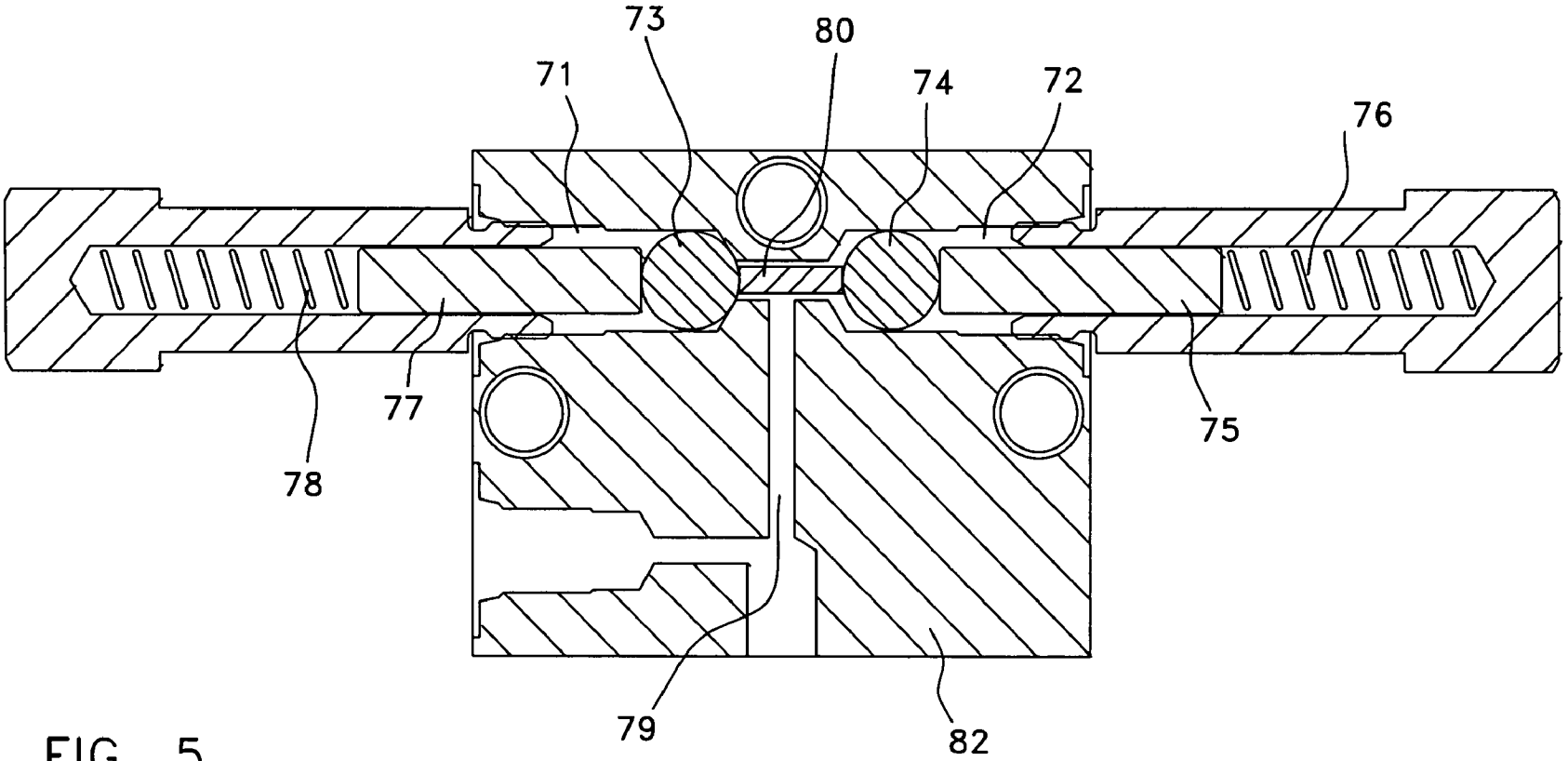
FIG. 5 is a section view of a valve assembly according to a preferred embodiment of the present invention.

Referring to FIG. 5, the present invention also preferably provides a hydraulic valve to direct fluid flow from two hydraulic lines to a reservoir. The hydraulic valve comprises a body having a pair of supply ports and a reservoir port. The supply ports are in fluid communication with the hydraulic lines and the reservoir port is in fluid communication with the reservoir. The hydraulic valve also comprises a first channel 71 extending from the first supply port towards a center of the body and a second channel 72 extending from the second supply port towards the center of the body. The two channels 71, 72 are coaxially aligned on opposite sides of the body, and meet at the center of the body. The channels 71, 72 converge towards a transverse third channel 79 extending towards the reservoir port. The valve further comprises first and second sealing surfaces having opposing outward tapers facing the first and second channels 71, 72. The valve also comprises a shuttle including a central shaft 80 and two balls 73, 74 affixed to the central shaft 80 on opposite ends thereof, the shuttle slidably moving between sealing engagement of the first ball 73 with the first sealing surface and sealing engagement of the second ball 74 with the second sealing surface. First and second spring means 78, 76 are in contact with the first and second balls 73, 74 respectively and adapted to apply a force on the balls 73, 74 towards the center of the body.

A higher fluid pressure in the first supply port compared to the second supply port results in sealing engagement of the first ball 73 with the first sealing surface while allowing fluid flow between the second supply port and the reservoir. A higher fluid pressure in the second supply port compared to the first supply port results in sealing engagement of the second ball 74 with the second sealing surface while allowing fluid flow between the first supply port and the reservoir.

More particularly, the channel 71 is connected to the hydraulic port of the motor. The other channel 72 is connected to the other hydraulic port of the motor. The third channel 79 is directly connected to the hydraulic reservoir.

Preferably, the spring 78 presses against the shaft 77. This force is transmitted to the ball 73, which in turn presses against the central shaft 80. In a symmetrical and opposite manner, the second spring 76 presses against the second shaft 75. This force is transmitted to the second ball 74, which presses against the other side of the central shaft 80.

Preferably, the hydraulic pressure in the channel 71 comes from the motor 50 and presses against the ball 73. In a symmetrical and opposite manner, the hydraulic pressure in the channel 72 comes from the other port of the motor and presses against the ball 74.

If the hydraulic pressure of the channel 72 is greater than the hydraulic pressure in the channel 71, the resulting force will make the ball 74 press against the bottom of the opening in the block 82. In pressing against this opening in this manner, the ball 74 blocks completely the passage between the opening 72 and the channel 79. At the same time, the ball 74 presses against the central shaft 80 and displaces the ball 73, which consequently does not press against the bottom of the opening on its side. Consequently, oil from the opening 71 passes around the ball 73 and travels through the channel 79 toward the hydraulic reservoir.

If the hydraulic pressure of the opening 71 is greater than the hydraulic pressure in the opening 72, an opposite action occurs by symmetry. The ball 73 completely blocks the passage of hydraulic fluid between the opening 71 and the channel 79, and consequently fluid from the opening 72 passes around the ball 74 and travels towards the hydraulic reservoir.

Consequently, there is no oil leak between the high-pressure line of the motor and the reservoir. On the other hand, the low-pressure line of the motor communicates with the reservoir and pressure therefore decreases on this side of the motor.

Although the present invention has been explained hereinabove by way of a preferred embodiment thereof, it should be understood that the invention is not limited to this precise embodiment and that various changes and modifications may be effected therein without departing from the scope or spirit of the invention.

What is claimed is:

1. A rotator assembly for rotating and actuating an operable attachment, the rotator assembly comprising:

a load-bearing shaft adapted to be mounted to a boom member displacing said rotator assembly; said load-bearing shaft having:

a central recess at a bottom end thereof; and a first and a second channel extending through the shaft, each of said first and second channel having a bottom end emerging in the central recess, said first and second channel allowing passage of a pressurized fluid used for actuating the operable attachment;

a drive assembly rotatably mounted about the load-bearing shaft, the drive assembly having a bottom body portion securable to the operable attachment, said bottom body portion having a central recess in an upper portion thereof in registry with the central recess of the load-bearing shaft and a first and a second channel in fluid communication with said central recess of the drive assembly; each of said first and second channel having a port in a bottom or side wall of the body portion for connection with hose means of the operable attachment;

an actuator operatively connected to the drive assembly such that an actuation force from the actuator is transmitted to the operable attachment to rotate the operable attachment about the load-bearing shaft;

a first tube having an upper end portion housed in the central recess of the load-bearing shaft and a lower end portion housed in the central recess of the drive assembly, said first tube having a top end in registry with the bottom end of said first channel of the load-bearing shaft and a bottom end in fluid communication with the first channel of the bottom body portion of the drive assembly, thereby allowing a first flow path for the pressurized fluid from the load-bearing shaft to the operable attachment; and a second tube concentrically positioned around the first tube and an annular passage between the first and second tube having an upper end in fluid communication with the bottom end of said second channel of the load-bearing shaft and a lower end in fluid communication with the second channel of the drive assembly, thereby allowing a second flow path for the pressurized fluid from the load-bearing shaft to the operable attachment.

2. The rotator assembly according to claim 1, the rotator assembly comprising:

a collector housed in the central recess of the load-bearing shaft, the collector having a body with a central alcove in a bottom end thereof, said alcove housing the upper end portion of the first tube and having an upper opening in registry with the bottom end of said first channel of the load-bearing shaft and with the top end of the first tube, said body further having a passage with an upper end in registry with the bottom end of said second channel of the load-bearing shaft and a lower end emerging in said central alcove and being in fluid communication with the upper end of said annular passage to provide said second flow path.

3. The rotator assembly according to claim 1, wherein the load-bearing shaft is part of an attachment structure having a top side with a boom interface and a bottom side from which the load-bearing shaft extends.

4. The rotator assembly according to claim 3, wherein the actuator comprises:

a motor mounted to the attachment structure; and a pinion gear operatively connected to the motor.

5. The rotator assembly according to claim 4, wherein:

the drive assembly comprises:

a jacket-shaped bearing rigidly connected to a top end of said bottom body portion, said jacket-shaped bearing housing and surrounding the load-bearing shaft; and an annular gear secured to a top end of the jacket-shaped bearing, said annular gear being in operative engagement with the pinion gear of the actuator; and the rotator assembly further comprises:

a rotator casing having a top side securable to said attachment structure, a bottom side provided with an aperture and a lodging for receiving the pinion gear, the rotator casing being for mounting said jacket-shaped bearing and annular gear around the load-bearing shaft with said bottom body portion of the drive assembly projecting out from said aperture.

6. The rotator assembly according to claim 5, wherein the jacket-shaped bearing is rigidly connected to the bottom body portion by means of a conical cover having a flared top side securable to a bottom end of the jacket-shaped bearing and a bottom side securable to the top end of the bottom body portion.

7. The rotator assembly according to claim 1, wherein the first and second tubes each comprise a first extremity and a second extremity, both extremities each having a spherical portion in proximity thereof, and the rotator assembly comprises a plurality of seals, each seal pressing against each of the spherical portions of the tubes.

8. The rotator assembly according to claim 7, wherein the spherical portions are pivotally connected to the drive assembly and to the collector.

9. The rotator assembly according to claim 1, wherein the actuator is a hydraulic drive motor.

10. The rotator assembly according to claim 1, wherein the actuator is a motor comprising a hydraulic valve to direct fluid flow from two hydraulic lines to a reservoir, the hydraulic valve comprising:

a body having a pair of supply ports and a reservoir port, the supply ports being in fluid communication with the hydraulic lines and the reservoir port being in fluid communication with the reservoir;

a first channel extending from the first supply port towards a center of the body and a second channel extending from the second supply port towards the center of the body, the two channels being coaxially aligned on opposite sides of the body, meeting at the center of the body and converging towards a transverse third channel extending towards the reservoir port;

first and second sealing surfaces having opposing outward tapers facing the first and second channels;

a shuttle including a central shaft and two balls affixed to the central shaft on opposite ends thereof, the shuttle being slidably moveable between sealing engagement of the first ball with the first sealing surface and sealing engagement of the second ball with the second sealing surface;

first and second spring means in contact with the first and second balls respectively and adapted to apply a force on the balls towards the center of the body;

wherein a higher fluid pressure in the first supply port compared to the second supply port results in sealing engagement of the first ball with the first sealing surface while allowing fluid flow between the second supply port and the reservoir and a higher fluid pressure in the second supply port compared to the first supply port results in sealing engagement of the second ball with the second sealing surface while allowing fluid flow between the first supply port and the reservoir.

11. A rotator assembly linking a boom member to an operable attachment, the rotator assembly comprising:

a stator mounted on one of the boom member and operable attachment, said stator having:

a central recess; and a first and a second channel extending through the stator, each of said first and second channels being in communication with said central recess;

a rotor rotatably mounted about the stator, the rotor having:

an interface securable to the other one of said operable attachment and boom member;

a central recess in registry with the central recess of the stator; and a first and a second channel in communication with said central recess of the rotor, each of said first and second channels having a port in a bottom or side wall of the rotor;

a first tube having a first end portion housed in the central recess of the stator and a second end portion housed in the central recess of the rotor, said first tube having said first end in communication with said first channel of the stator and said second end in communication with the first channel of the rotor, thereby allowing a first travel path from the boom member to the operable attachment; and a second tube concentrically positioned around the first tube and an annular passage between the first and second tube, said second tube having a first end in communication with the second channel of the stator and a second end in communication with the second channel of the rotor, thereby allowing a second travel path from the boom member to the operable attachment.

12. The rotator assembly according to claim 11, wherein the first and second travel path are flow paths for pressurized fluid.

13. The rotator assembly according to claim 11, wherein cabling is placed through the first travel path.

14. The rotator assembly according to claim 11, wherein the first and second tubes each comprise a first extremity and a second extremity, both extremities each having a spherical portion in proximity thereof, and the rotator assembly comprises a plurality of seals, each seal pressing against each of the spherical portions of the tubes.

15. The rotator assembly according to claim 14, wherein the spherical portions are pivotally connected to the stator and to the rotor.

16. The rotator assembly according to claim 11, wherein the rotator assembly further comprises an actuator operatively connected to the rotor such that an actuation force from the actuator is transmitted to the operable attachment to rotate the operable attachment about the stator.

* * * * *